US009982863B2

(12) United States Patent
Wang

(10) Patent No.: US 9,982,863 B2
(45) Date of Patent: May 29, 2018

(54) LIGHT DISTANCE-ADJUSTABLE VEHICLE LAMP DEVICE

(71) Applicant: Cheng Wang, Taipei (TW)

(72) Inventor: Cheng Wang, Taipei (TW)

(73) Assignee: ADI OPTICS CO., LTD., New Taipei (TW)

( * ) Notice: Subject to any disclaimer, the term of this patent is extended or adjusted under 35 U.S.C. 154(b) by 116 days.

(21) Appl. No.: 15/045,336

(22) Filed: Feb. 17, 2016

(65) Prior Publication Data

US 2016/0238208 A1 Aug. 18, 2016

(30) Foreign Application Priority Data

Feb. 17, 2015 (TW) ..... 104105557 A

(51) Int. Cl.
*F21S 8/10* (2006.01)
*F21Y 105/12* (2016.01)

(52) U.S. Cl.
CPC ..... *F21S 48/1705* (2013.01); *F21S 41/143* (2018.01); *F21S 41/255* (2018.01); *F21S 41/26* (2018.01); *F21S 41/265* (2018.01); *F21S 41/60* (2018.01); *F21S 41/663* (2018.01); *F21Y 2105/12* (2016.08)

(58) Field of Classification Search
CPC ..... F21S 48/1705
USPC ..... 362/521
See application file for complete search history.

(56) References Cited

U.S. PATENT DOCUMENTS 7,168,832 B2 * 1/2007 Komatsu ..... G02B 3/08 362/328
2001/0008486 A1 * 7/2001 Futami ..... B60Q 1/0041 362/512
2005/0105301 A1 * 5/2005 Takeda ..... F21S 48/1154 362/545
2010/0002460 A1 * 1/2010 Rosenhahn ..... F21S 48/1154 362/521
2010/0202152 A1 * 8/2010 Nakada ..... F21S 48/1159 362/517
2013/0343076 A1 * 12/2013 Nakada ..... F21S 48/1317 362/516

(Continued)

FOREIGN PATENT DOCUMENTS

CN 202452347 U 9/2012
CN 102834662 A 12/2012

(Continued)

*Primary Examiner* — Michael G Lee
*Assistant Examiner* — David Tardif
(74) *Attorney, Agent, or Firm* — Li & Cai Intellectual Property (USA) Office

(57) ABSTRACT

The instant disclosure illustrates a light distance-adjustable vehicle lamp including a lens unit, a light emitting group and a datum axis. The lens unit includes a first focus, a second focus, a lens focus and an optical axis. The light emitting group includes a first light emitting unit and a second light emitting unit. The first light emitting unit includes a first light source center, a first axis and a first light emitting surface, the first light emitting unit corresponds to the first focus of the lens unit. The second light emitting unit includes a second light source center, a second axis and a second light emitting focus. The datum axis passes through the lens focus and the second light emitting unit.

9 Claims, 17 Drawing Sheets

(56) References Cited

U.S. PATENT DOCUMENTS

| | | | | |
|---|---|---|---|---|
| 2014/0043842 | A1* | 2/2014 | Mochizuki | F21S 48/17 362/543 |
| 2014/0233253 | A1* | 8/2014 | Owada | F21S 48/1382 362/516 |
| 2015/0043240 | A1* | 2/2015 | Wiersdorff | F21S 48/125 362/520 |
| 2015/0252975 | A1* | 9/2015 | Nakada | F21S 48/1154 362/521 |

FOREIGN PATENT DOCUMENTS

| | | | |
|---|---|---|---|
| CN | 203823633 | U | 9/2014 |
| TW | M463226 | U | 10/2013 |
| TW | M485162 | U | 9/2014 |
| TW | M485842 | U | 9/2014 |
| TW | M504737 | U | 7/2015 |

* cited by examiner

LIGHT DISTANCE-ADJUSTABLE VEHICLE LAMP DEVICE

BACKGROUND

1. Technical Field

The present disclosure relates to a vehicle lamp device, in particular, to a light distance-adjustable vehicle lamp device. The vehicle lamp is adapted to bicycle, motorcycle and automobile, etc.

2. Description of Related Art

Light-emitting modules of conventional vehicle headlamps may be classified into tungsten halogen lamps and High Intensity Discharge (HID) lamps, in which the tungsten halogen lamp has an arc length of 5.6 mm and the HID lamp has an arc length of 4.3 mm. In order to match with traditional illumination lamp sources, the light-collecting system the conventional vehicle headlamps generally employs a single optical axis and a single light-emitting module. At present, in order to simulate the arc lengths and sizes of a tungsten halogen lamp and an HID lamp, a light-emitting diode module disposed in the vehicle headlight adopts a continuous light-emitting diode package form. In the case under a single optical axis and a single focus, only a single light-emitting module can be used and hence, light-emitting diodes having a size of 1 mm×1 mm are most often serve as units for packaging. The continuous light-emitting diode package form means that a plurality of light-emitting diodes are packed on a silicon substrate through a eutectic process or other processes, so that the distance between the grains (chips) of the light-emitting diodes may be less than 0.2 mm and may even be as small as less than 0.05 mm. Due to the smaller distance between the light-emitting diodes, the combination of the light-emitting diodes may be regarded as a continuous light emitter. However, with the same brightness, the cost of the continuous light-emitting diode package is at least 10 times more than a common light-emitting diode manufactured through a common process. In other words, the conventional light emitting diode packages for lighting are discontinuous light emitters and are manufactured by directly packing a single grain (chip) of light emitting diode, or directly packing two or three grains of light emitting diode. The light emitting diode formed by discontinuous process means that the distance between each two grains of light emitting diode is larger than 0.2 mm or 0.5 mm, or the distance between each two grains of light emitting diode is up to 4 mm.

Generally, the light emitting module of front lights for an automobile in the prior art is for providing a light distance adjusting function to switch between high beam (far light) and low beam (near light) according to the requirements of driving vision. For example, Taiwan patent No. 1332910 discloses a "semiconductor solid-state light emitting automobile front light with adjustable light distance" which utilizes the combination of a semiconductor solid-state light source and a movable light-shielding plate to achieve adjustable light distance. Furthermore, Taiwan patent No. M353845 discloses a "vehicle lamp for lighting" which utilizes separate high beam and low beam module to achieve the switch between the near light and far light.

Furthermore, Taiwan patent No. M492846 discloses a "LED projecting lamp with adjustable light distance" which involves the arrangement of two LED lights positioned on the upper surface and the lower surface of a substrate respectively, in which the two LED lights correspond to two different reflecting mirrors with different curvature, thereby achieving the function of light distance adjustment.

However, the above patents involve the use of complicated structures to achieve the function of light distance adjustment. Therefore, there is a need for providing the function of light distance adjustment through a single lens.

SUMMARY

In view of the above problem, the embodiment of the instant disclosure provides a light distance-adjustable vehicle lamp which utilizes a specific arrangement of a single lens and a light emitting diode to achieve the switch between the near light and the far light, and the light emitted from such a vehicle lamp would also be in compliance with laws and administrative regulations. Moreover, the vehicle lamp provided by the embodiment of the instant disclosure has reduced manufacturing cost.

In order to achieve the above purposes, an exemplary embodiment of the present disclosure provides a light distance-adjustable vehicle lamp device comprising a lens unit, a light emitting group, a datum axis and a reference axis. The lens unit comprises a first focus, a second focus, a lens focus and an optical axis, in which the optical axis passes through the lens focus. The light emitting group is arranged corresponding to the lens unit, the light emitting group comprises a first light emitting unit and a second light emitting unit. The first light emitting unit has a first light source center, a first axis and a first light emitting surface, the first axis passes through the first light source center, the first light emitting surface has a plurality of first surrounding edges, two adjacent first surrounding edges cross at an end point, in which the first light emitting unit corresponds to the first focus of the lens unit. The second light emitting unit is arranged corresponding to the first light emitting unit, the second light emitting unit has a second light source center, a second axis, and a second light emitting surface, the second axis passes through the second light source center, the second light emitting surface has a plurality of second surrounding edges, in which the second light emitting unit corresponds to the second focus of the lens unit. The datum axis passes through the lens focus and the second light emitting unit. The reference axis passes through one of the plurality of first surrounding edges, and the reference axis passes through the end point, in which the reference axis and the datum axis have a predetermined angle therebetween, and the predetermined angle is between 0 and 90 degrees. The lens focus is positioned between the first axis and the second axis. The end point is positioned between the datum axis and the first light source center.

The advantage of the instant disclosure resides in that by utilizing the combination of a lens unit and a light emitting group comprising a first light emitting unit as the near light and a second light emitting unit as the far light, the light distance-adjustable vehicle lamp device provided by the embodiment of the instant disclosure may achieve the function of light distance adjustment by using a single lens unit. In addition, the first light emitting unit and the second light emitting unit are off-set from each other and one of the end points of the first light emitting unit is positioned between the datum axis and the first light source center, and hence, the light distance adjustable vehicle lamp device has a structure smaller than that of the prior art.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the present disclosure.

DESCRIPTION OF THE EXEMPLARY EMBODIMENTS

Figure 1:
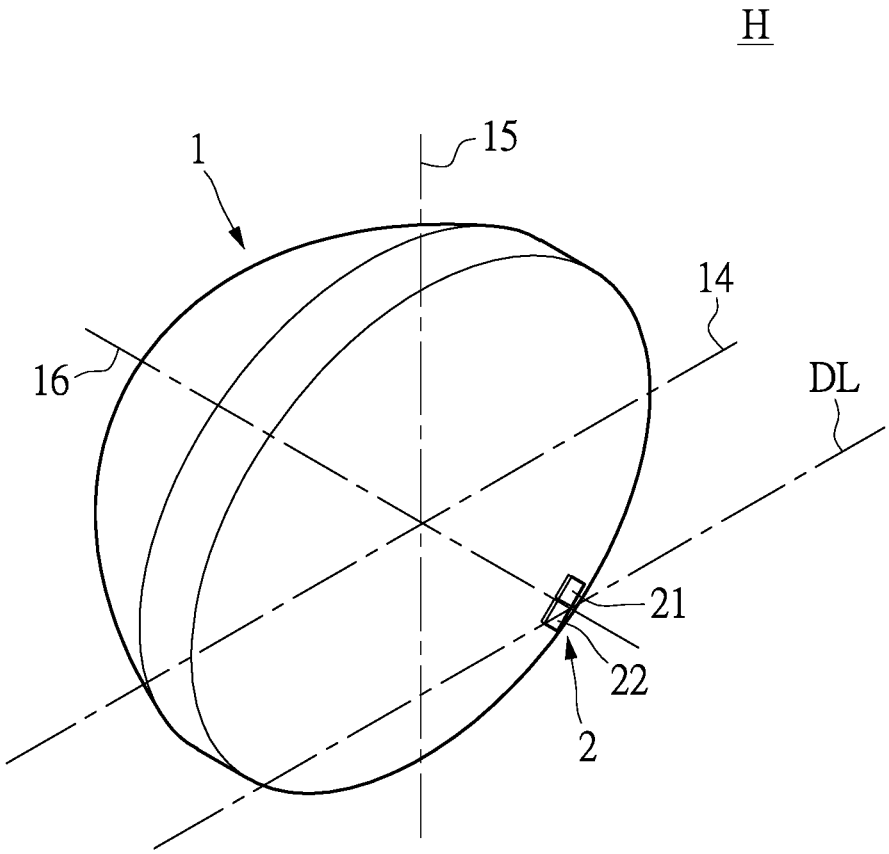
FIG. 1 is a 3-dimensional view of a vehicle lamp device of a first embodiment of the instant disclosure.
Figure 2:
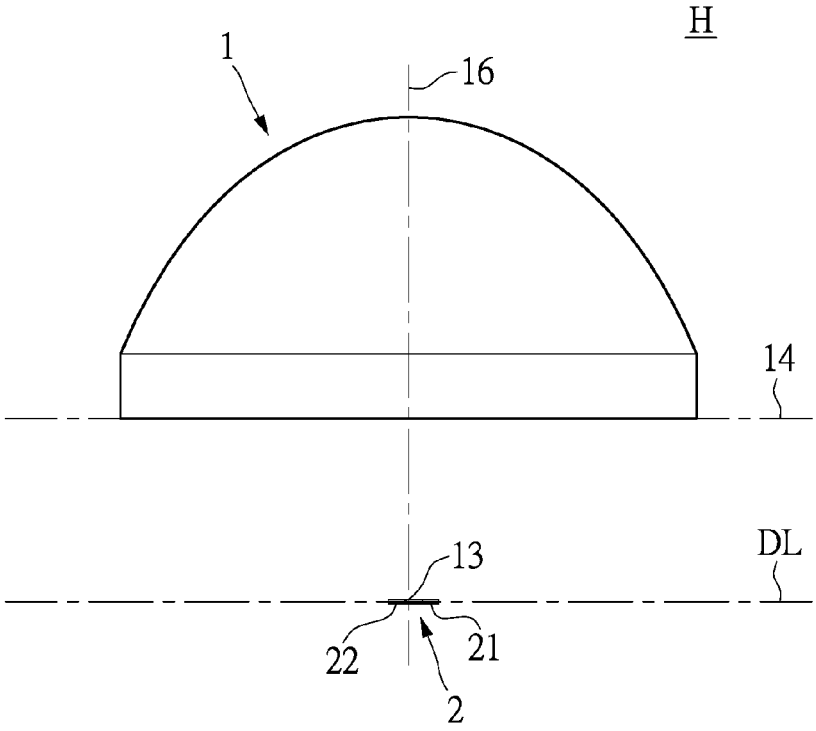
FIG. 2 is a top view of the vehicle lamp device of a first embodiment of the instant disclosure.
Figure 3:
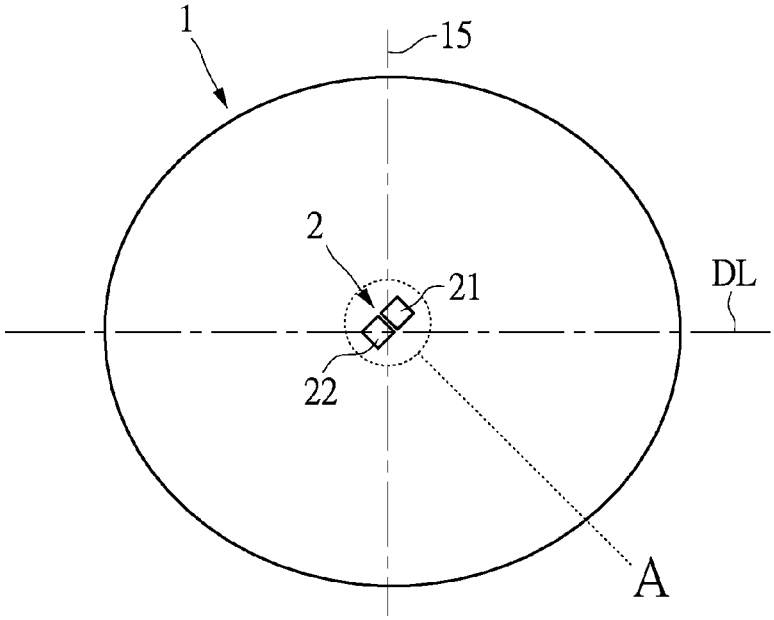
FIG. 3 is a front view of the vehicle lamp device of a first embodiment of the instant disclosure.

Reference will now be made in detail to the exemplary embodiments of the instant disclosure, examples of which are illustrated in the accompanying drawings. Wherever possible, the same reference numbers are used in the drawings and the description to refer to the same or like parts.

First Embodiment

First, please refer to FIGS. 1 to 4. The first embodiment of the instant disclosure provides a light distance adjustable vehicle lamp device H comprising a lens unit 1, a light emitting group 2, a datum axis DL and a reference axis RL. The lens unit 1 may be a lens with a complex curvature comprising at least two curved surfaces with different curvature, and the lens 1 has a first focus 11, a second focus 12, a lens focus 13, a horizontal axis 14, a vertical axis 15 and an optical axis 16. For example, the first focus 11 and the second focus 12 of the lens unit 1 may be formed by two curved surfaces with different curvature. The horizontal axis 14 and the vertical axis 15 of the lens unit 1 are orthogonal to each other, and the optical axis 16 of the lens unit 1 passes through the lens focus 13 of the lens unit 1. In addition, in other embodiments, the horizontal axis 14, the vertical axis 15 and the optical axis 16 may be orthogonal to each other.

The light emitting group 2 is arranged corresponding to the lens unit 1. Taking the first embodiment of the instant disclosure as an example, the light emitting group 2 may comprise a first light emitting unit 21 and a second light emitting unit 22. For example, the first light emitting unit 21 and the second light emitting unit 22 provided by the embodiment of the instant disclosure may be light emitting diodes, and the size of the light emitting diodes may be 1.14 millimeter by 1.14 millimeter. However, the instant disclosure is not limited thereto. In the embodiments of the instant disclosure, the first light emitting unit 21 may serve as the low beam (near light) of the vehicle lamp device H, and the second light emitting unit 22 may serve as the high beam (far light) of the vehicle lamp device H. However, the instant disclosure is not limited thereto.

Figure 4:
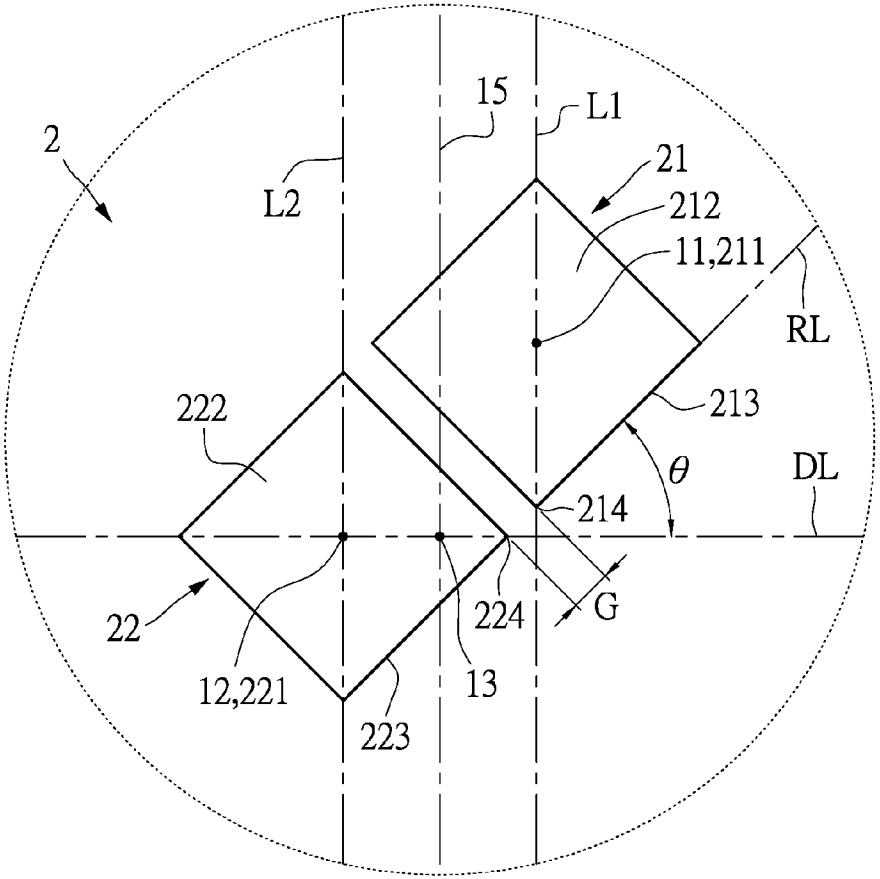
FIG. 4 is a partial enlargement of part A in FIG. 3.

Next, please refer to FIG. 4. The first light emitting unit 21 may have a first light source center 211, a first axis L1 and a first light emitting surface 212, the first axis L1 passes through the first light source center 211, and the first axis L1 is parallel to the vertical axis 15 of the lens unit 1. The first light emitting surface 212 may have a plurality of first surrounding edges 213, two adjacent first surrounding edges 213 may cross at an end point 214. For example, the first light emitting unit 21 may have four first surrounding edges 213, and the four first surrounding edges 213 may form four end points 214. In addition, the first light source center 211 of the first light emitting unit 21 may be arranged corresponding to the first focus 11 of the lens unit 1. For example, the first light source center 211 of the first light emitting unit 21 may coincide with the first focus 11 of the lens unit 1. However, the instant disclosure is not limited thereto. In other embodiments, by adjusting the position of the first light emitting unit 21, the first light source center 211 may be positioned at a side of the first focus 11, thereby adjusting the light pattern generated by the vehicle lamp device H.

As mentioned above, the second light emitting unit 22 is arranged corresponding to the first light emitting unit 21, and hence, the first light emitting unit 21 and the second light emitting unit 22 are off-set from each other. The second light emitting unit 22 has a second light source center 221, a second axis L2 and a second light emitting surface 222, the second axis L2 passes through the second light source center 221, and the second axis L2 is parallel to the vertical axis 15 of the lens unit 1. The second light emitting surface 222 may have a plurality of second surrounding edges 223, and two adjacent second surrounding edges 223 cross at an end point 224. In addition, the second light source center 221 of the second light emitting unit 22 may be arranged corresponding to the second focus 12 of the lens unit 1. For example, the second light source center 221 of the second light emitting unit 22 may coincide with the second focus 12 of the lens unit 1. However, the instant disclosure is not limited thereto. In other embodiments, by adjusting the position of the second light emitting unit 22, the second light source center 221 could be positioned on a side of the second focus 12, thereby adjusting the light pattern generated by the vehicle lamp device H.

A datum axis DL is parallel to the horizontal axis 14 of the lens unit 1, and the datum axis DL may pass thru the lens focus 13 of the lens unit 1 and the second light emitting unit 22. For example, the datum axis may pass through the second light source center 221 of the second light emitting unit 22 and two end points 224 of the second light emitting unit 22. However, the instant disclosure is not limited thereto. In other words, in the other embodiments, the datum axis DL does not have to pass through two end points 224 of the second light emitting unit 22 and may pass through the second light source center 221 and two surrounding edges 223 of the second light emitting unit 22.

The reference axis RL passes through one of the plurality of first surrounding edges 213 of the first light emitting unit 21, and the reference axis RL passes through the end points 214 of the first light emitting unit 21. The reference axis RL and the datum axis DL may have a predetermined angle θ therebetween, and the predetermined angle θ is from 0 degrees to 90 degrees. For example, in the first embodiment of the instant disclosure, the predetermined angle θ may be 45 degrees. However, the instant disclosure is not limited thereto. By adjusting the predetermined angle θ, the width of the light generated by the vehicle lamp device H may be controlled.

In the first embodiment, the lens focus 13 of the lens unit 1 may be positioned between the first axis L1 and the second axis L2, and one end point 214 of the first light emitting unit 21 may be positioned between the datum axis DL and the first light source center 211. In other words, the lowest light emitting position of the first light emitting surface 211 of the first light emitting unit 21 is positioned between the datum axis DL and the first light source center 211. Furthermore, preferably, in the first embodiment, the lens focus 13 may be positioned at the center point between the first axis L1 and the second axis L2. Therefore, the distance between the lens focus 13 of the lens unit 1 and the first axis L1 is equal to the distance between the lens focus 13 of the lens unit 1 and the crossing point of the second axis L2 and the datum axis DL.

Next, in the first embodiment of the instant disclosure, the nearest distance between the first light emitting surface 212 of the first light emitting unit 21 and the second light emitting surface 222 of the second light emitting unit 22 may be a predetermined gap G and the predetermined gap G may be from 0 to 4 millimeter. Preferably, in a continuous light emitting diode, the predetermined gap G may be from 0 millimeter to 0.2 millimeter. More preferably, in a discontinuous light emitting diode, the predetermined gap G may be from 0.2 millimeter to 4 millimeter, or from 0.5 millimeter to 4 millimeter. Furthermore, as shown in FIG. 4, one of the plurality of first surrounding edges 213 of the first light emitting unit 21 may be parallel to one of the plurality of second surrounding edges 223 of the second light emitting unit 22. Therefore, the predetermined gap G between two directly adjacent first surrounding edge 213 and second surrounding edge 223 may be from 0 to 4 millimeter, preferably from 0 millimeter to 0.2 millimeter, from 0.2 millimeter to 4 millimeter or from 0.5 to 4 millimeter. In other words, in a discontinuous form, the first light emitting unit 21 and the second light emitting unit 22 may be light emitting diodes and are packed in a same package, and the predetermined gap G between the first light emitting unit 21 and the second light emitting unit 22 may be from 0.2 millimeter to 4 millimeter or from 0.5 millimeter to 4 millimeter. However, in other embodiments, the first light emitting unit 21 and the second light emitting unit 22 may be individually packed light emitting diodes, and the predetermined gap G between the first light emitting unit 21 and the second light emitting unit 22 may be from 0.2 millimeter to 4 millimeter or from 0.5 millimeter to 4 millimeter. In addition, in the continuous type, the first light emitting unit 21 and the second light emitting unit 22 may comprise a plurality of light emitting diode chips, and the distances between each light emitting diode chip are from 0 millimeter to 0.2 millimeter.

Figure 5:
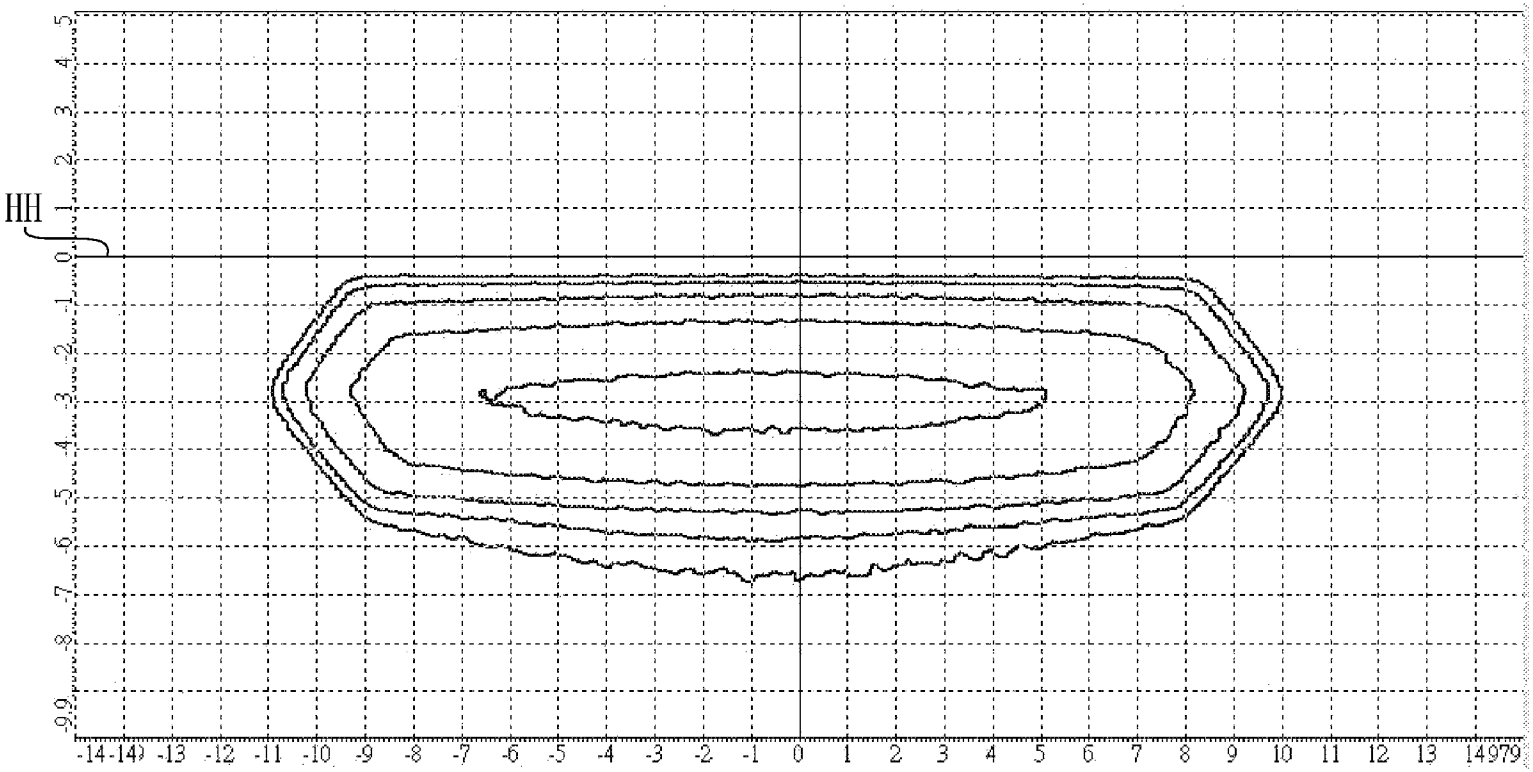
FIG. 5 is a schematic view of one of the light pattern projections generated by the first embodiment of the instant disclosure.
Figure 6:
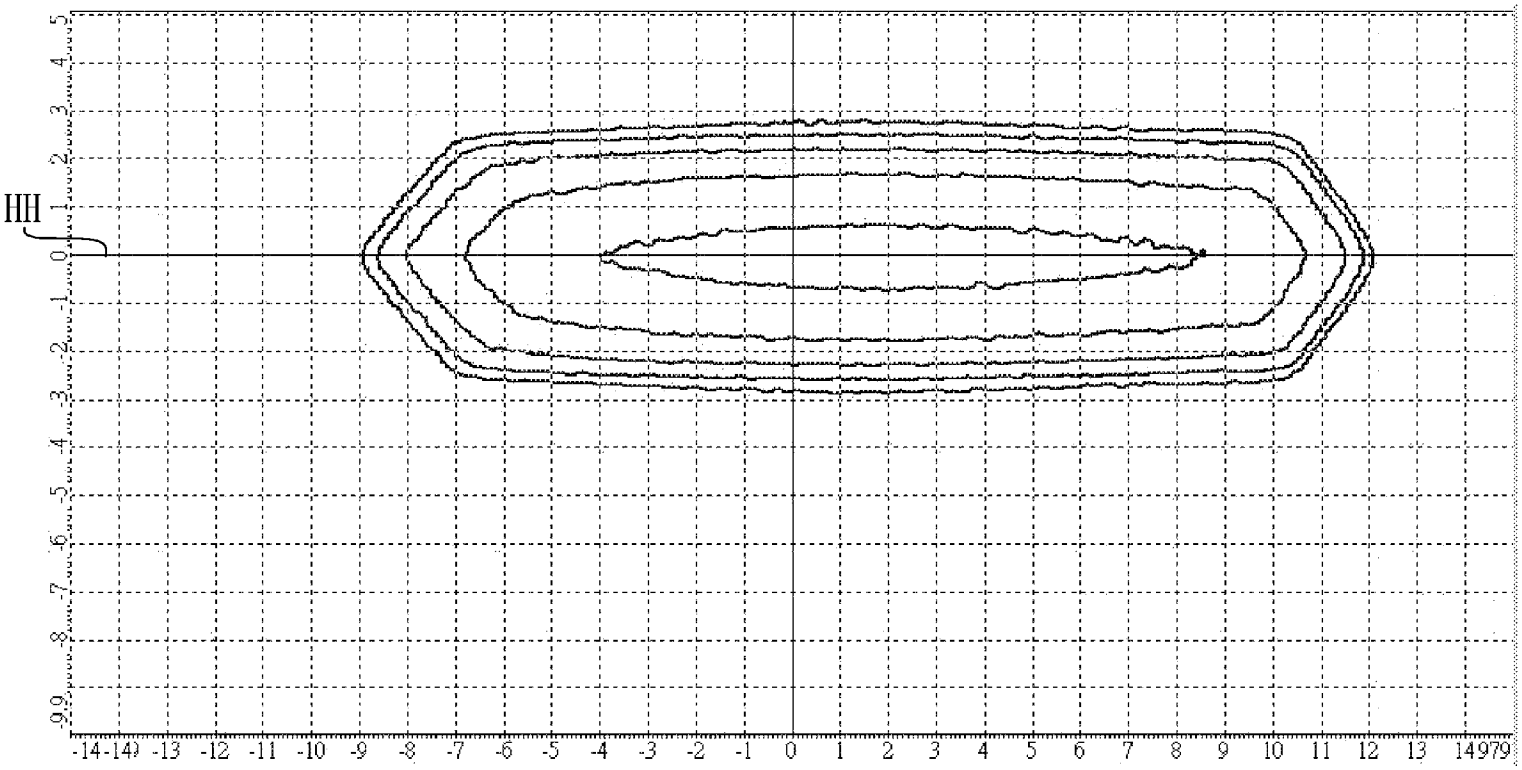
FIG. 6 is another schematic view of one of the light pattern projections generated by the first embodiment of the instant disclosure.
Figure 7:
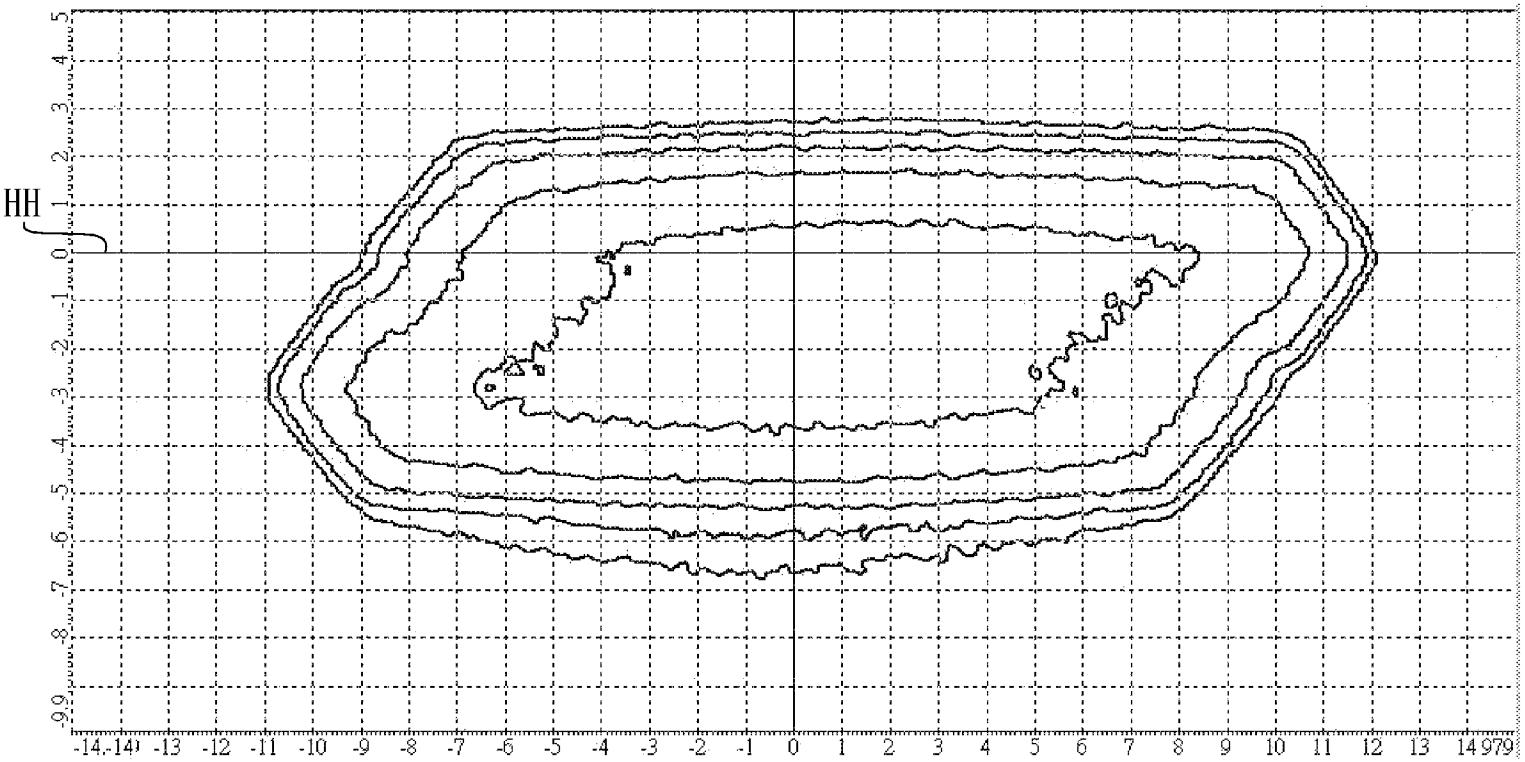
FIG. 7 is yet another schematic view of one of the light pattern projections generated by the first embodiment of the instant disclosure.
Figure 8:
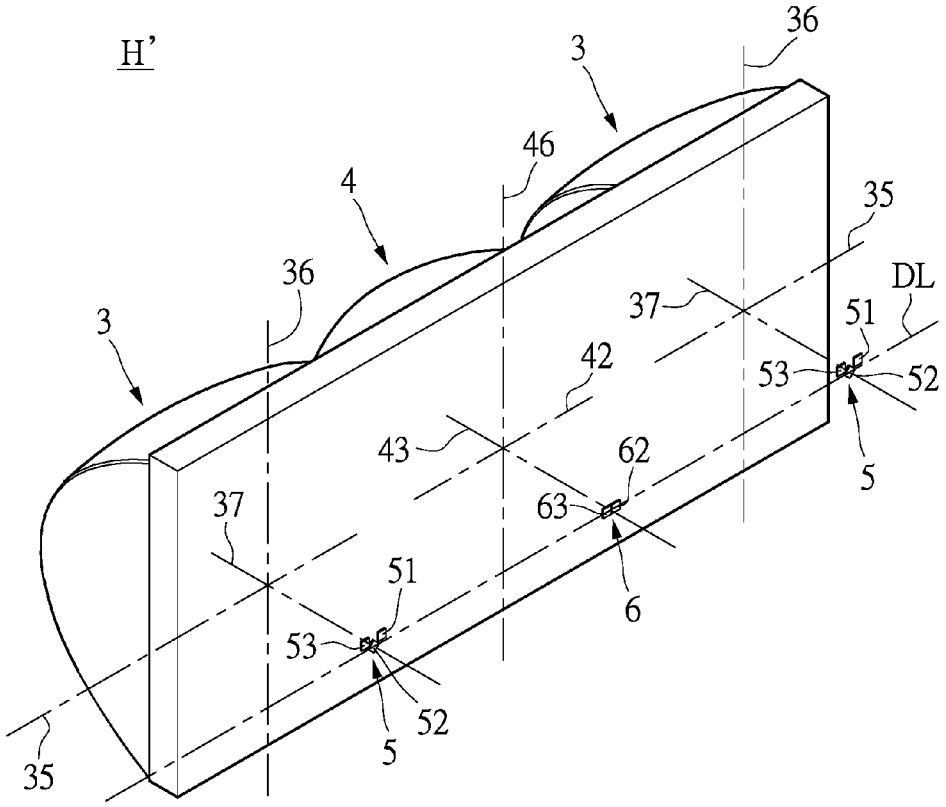
FIG. 8 is a 3-dimensional view of a vehicle lamp device of a second embodiment of the instant disclosure.
Figure 9:
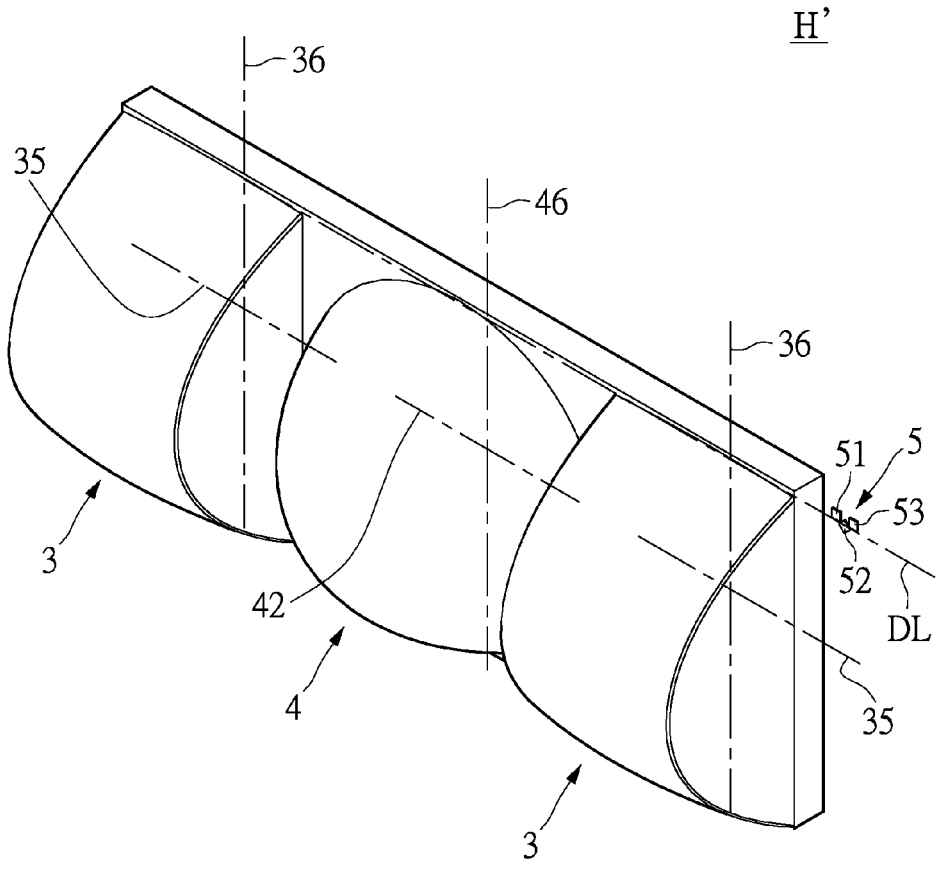
FIG. 9 is another 3-dimensional view of a vehicle lamp device of the second embodiment of the instant disclosure.
Figure 10:
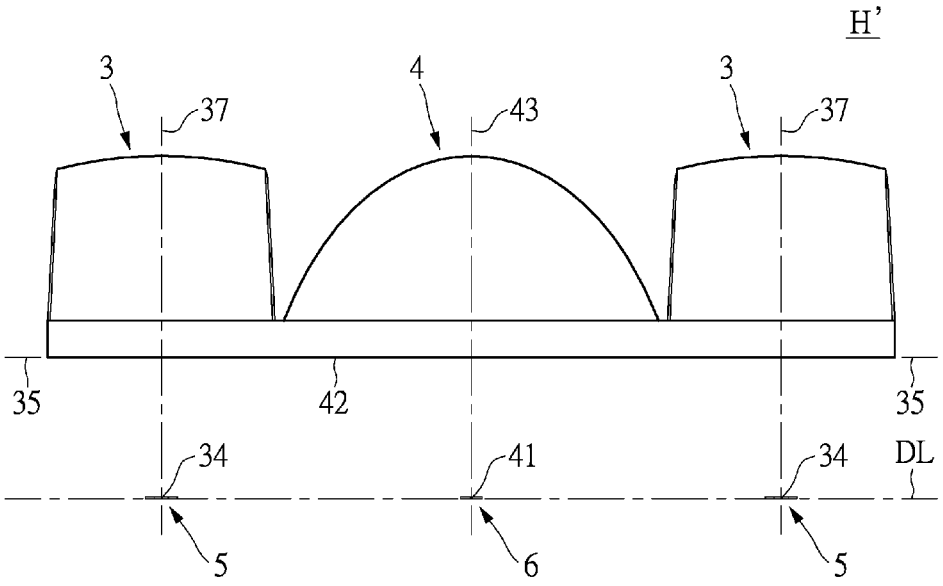
FIG. 10 is a top view of a vehicle lamp device of the second embodiment of the instant disclosure.
Figure 11:
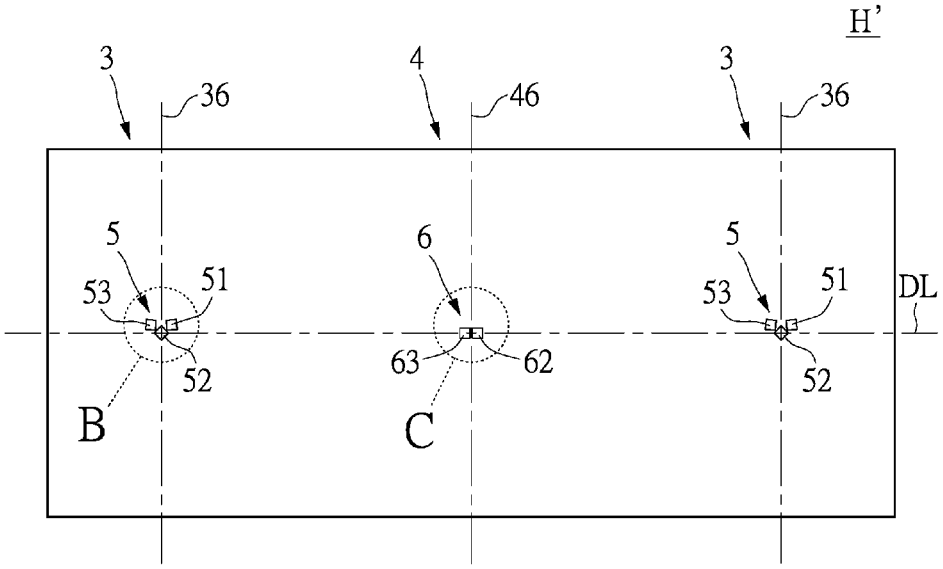
FIG. 11 is a front view of a vehicle lamp device of a second embodiment of the instant disclosure.

Next, please refer to FIG. 5 to FIG. 7. When the first light emitting unit 21 is on and the second light emitting unit 22 is off, the light pattern generated therefrom may be represented in FIG. 5. The light and dark boundary line is 0.57 degree below the horizontal line HH, and the light pattern projection is in conformity with the near light regulation of motorcycles in China (GB-19152-S4). When the second light emitting unit 22 is on and the first light emitting unit is off, the light pattern generated therefrom may be represented in FIG. 6. The lightest area of the light generated by the vehicle lamp device H is above the horizontal line HH, and the light pattern projection is in conformity with the far light regulation of motorcycles in China (GB-19152-S4). Next, when the first light emitting unit 21 and the second light emitting unit 22 are both on, the light pattern generated therefrom may be represented in FIG. 7. The light and dark boundary line is 3.4 degree above the horizontal line HH, and the light pattern projection is in conformity with the front light regulation of bicycles in Germany (STVZO 22A NO. 23). Furthermore, it is worthwhile to mention that the curvature of the lens unit 1 may be adjusted according to different regulations to enable the light generated by the first light emitting unit 21 and the second light emitting unit 22 to be in conformity with the regulations. In addition, in the light emitting group 2 shown in FIG. 4, the near light is arranged at the upper right relative to the far light. However, in other embodiments, the near light may be arranged at the upper left relative to the far light. Moreover, the light emitting group 2 may comprise more light emitting units to increase the light intensity and light width of the light generated by the vehicle lamp device H.

The light distance-adjustable vehicle lamp device H provided by the first embodiment of the instant disclosure includes the combination of a lens unit 1 with a light emitting group 2 having a first light emitting unit 21 as near light and the second light emitting unit 22 as far light, and hence, the function of light distance adjustment may be achieved by one lens unit 1. Furthermore, by arranging the first light emitting unit 21 and the second light emitting unit 22 off-set from each other and positioning one end point 214 of the first light emitting unit 21 between the datum axis DL and the first light source center 211, the light distance-adjustable vehicle lamp device H has smaller structure construction compared to the prior art.

Second Embodiment

First, please refer to FIG. 8 to FIG. 13. The second embodiment of the instant disclosure provides a light distance-adjustable vehicle lamp device H' comprising two first lens unit 3, a second lens unit 4, two first light emitting group 5, a second light emitting group 6, a datum axis DL, a first reference axis RL1 and a second reference axis RL2. In the second embodiment, each first lens unit 3 may be a lens with a complex curvature which comprises at least three curved surfaces with different curvatures, and each first lens unit 3 has a first focus 31, a second focus 32, a third focus 33, a lens focus 34, a horizontal axis 35, a vertical axis 36 and an optical axis 37. To be specific, the first focus 31, the second focus 32 and the third focus 33 of the first lens unit 3 are formed by the above three curved surfaces with different curvatures respectively. The horizontal axis 35 of the first lens unit 3 and the vertical axis 36 of the first lens unit 3 are vertical to each other. In addition, in the second embodiment, the lens focus 34 of each first lens unit 3 may coincide with the second focus 32 of the first lens unit 3, and the optical axis 37 of the first lens unit 3 may pass through the lens focus 34 and the second focus 32 of the first lens unit 3. In addition, the horizontal axis 35, the vertical axis 36 and the optical axis 37 of the first lens unit 3 may be orthogonal to each other.

Next, the second lens unit 4 may be arranged between the two first lens units 3, and the horizontal axis 35 of the two first lens units 3 may be parallel to the horizontal axis 42 of the second lens unit 4. In addition, the second lens unit 4 may be a lens with a complex curvature. The second lens unit 4 may have a lens focus 41, a horizontal axis 42, a vertical axis 46 and an optical axis 43, and the optical axis 43 of the second lens unit 4 may pass through the lens focus 41 of the second lens unit 4. In addition, in the second embodiment, the second lens unit 4 has a first focus 44 and a second focus 45. The first focus 44 and the second focus 45 of the second lens unit are formed by two different curved surfaces on the second lens unit 4 respectively. The lens focus 41 of the second lens unit 4 may be positioned between the first focus 44 and the second focus 45 of the second lens unit 4.

Figure 12:
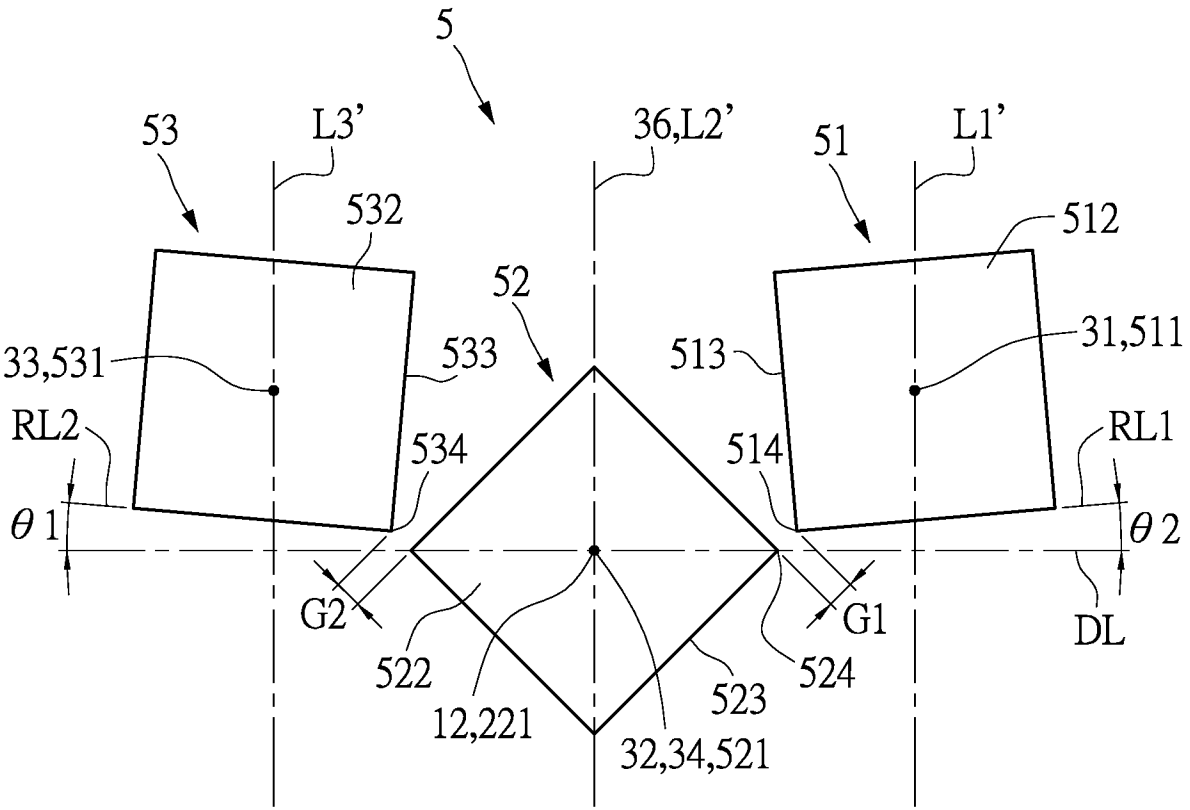
FIG. 12 is a partial enlargement of part B in FIG. 11.

As shown in FIG. 12, the two first light emitting groups 5 are arranged corresponding to the two first lens units 3, each first light emitting group 5 may comprise a first light emitting unit 51, a second light emitting unit 52 and a third light emitting unit 53. In the second embodiment, the second light emitting unit 52 may be arranged between the first light emitting unit 51 and the third light emitting unit 53, and the first light emitting unit 51 and the third light emitting unit 53 are symmetrically arranged on the two sides of the second light emitting unit 52. The first light emitting unit 51 and the third light emitting unit 53 may serve as the near light source of the vehicle lamp device H', and the second light emitting unit 52 may serve as the far light source of the vehicle lamp device H'.

The first light emitting unit 51 may have a first light source center 511, a first axis L1' and a first light emitting surface 512. The first axis L1' passes through the first light source center 511, and the first axis L1' is parallel to the vertical axis 36 of the first lens unit 3. The first light emitting surface 512 may have a plurality of surrounding edges 513, and two adjacent first surrounding edges 513 may cross at an end point 514. For example, the first light emitting unit 51 may have four first surrounding edges 513, and the four surrounding edges 513 may form four end points 514. In addition, the first light source center 511 of the first light emitting unit 51 may be arranged corresponding to the first focus 31 of the first lens unit 3. For example, the first light source center 511 of the first light emitting unit 51 may coincide with the first focus 31 of the first lens unit 3. However, the instant disclosure is not limited thereto. In other embodiments, by adjusting the position of the first light emitting unit 51, the first light source center 511 may be positioned at a side of the first focus 31, thereby adjusting the light pattern generated by the vehicle lamp device H'.

The second light emitting unit 52 and the first light emitting unit 51 are arranged corresponding to each other, so that the first light emitting unit 51 and the second light emitting unit 52 are off-set from each other. The second light emitting unit 52 has a second light source center 521, a second axis L2' and a second light emitting surface 522, the second axis L2' passes through the second light source center 521, and the second axis L2' is parallel to the vertical axis 36 of the first lens unit 3. The second light emitting surface 522 has a plurality of second surrounding edges 523, and two adjacent second surrounding edges 523 may cross at an end point 524. In addition, the second light source center 521 of the second light emitting unit 52 and the second focus 32 of the first lens unit 3 may be arranged corresponding to each other. For example, the second light source center 521 of the second light emitting unit 52 may coincide with the second focus 32 of the first lens unit 3. However, the instant disclosure is not limited thereto. In other embodiments, by adjusting the position of the second light emitting unit 52, the second light source center 521 may be positioned beside of the second focus 32 of the first lens unit 3, thereby adjusting the light pattern generated by the vehicle lamp device H'. In addition, in the second embodiment, the lens focus 34 of the first lens unit 3 may coincide with the second light source 521 of the second light emitting unit 52.

The third light emitting unit 53 is arranged corresponding to the second light emitting unit 52, so that the third light emitting unit 53 and the second light emitting unit 52 are off-set from each other. The third light emitting unit 53 may have a third light source center 531, a third axis L3' and a third light emitting surface 532. The third axis L3' is parallel to the vertical axis 36 of the lens unit 3, the third light emitting surface 532 has a plurality of surrounding edges 533, and two adjacent surrounding edges 533 cross at an end point 534. In addition, the third light source center 531 of the third light emitting unit 53 may be arranged corresponding to the third focus 33 of the first lens unit 3. For example, the third light source center 531 of the third light emitting unit 53 may coincide with the third focus 33 of the first lens unit 3. However, the instant disclosure is not limited thereto. In other embodiments, by adjusting the position of the third light emitting unit 53, the third light source center 531 may be positioned beside the third focus 33 of the first lens unit 3, thereby adjusting the light pattern generated by the vehicle lamp device H'.

Figure 13:
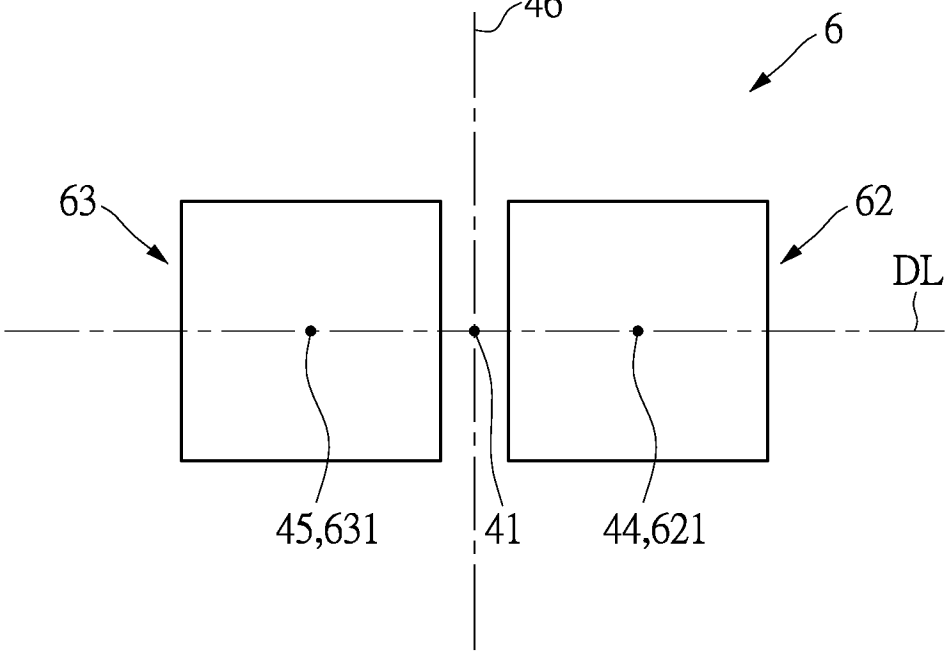
FIG. 13 is a partial enlargement of part C in FIG. 11.
Figure 14:
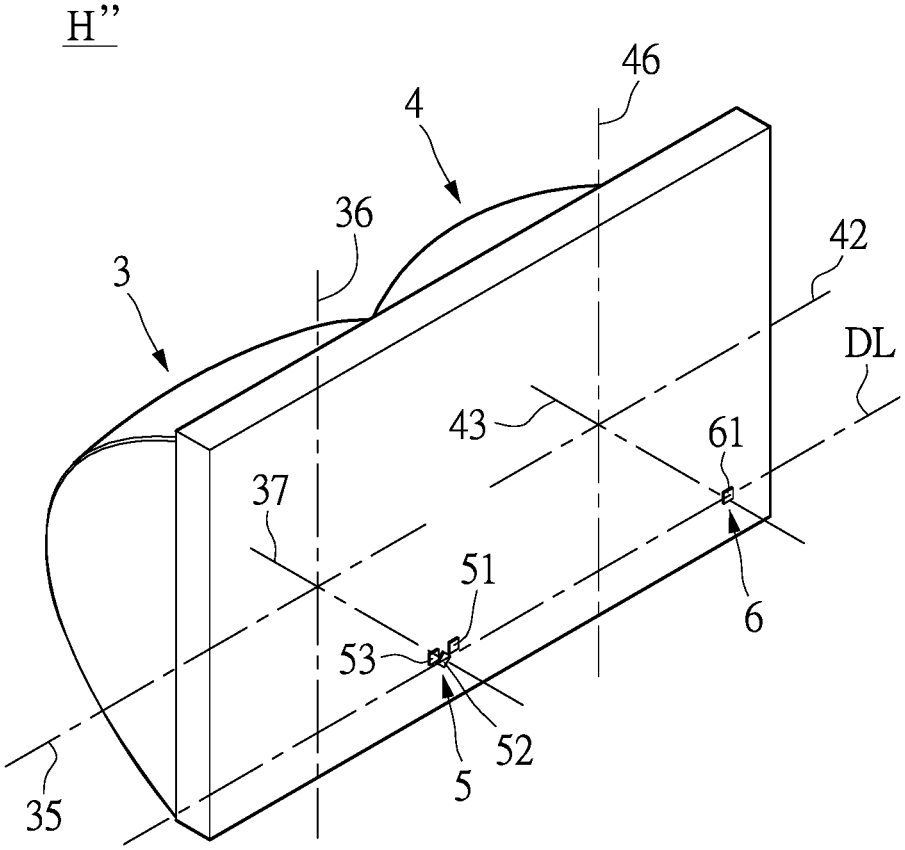
FIG. 14 is a 3-dimensional view of a vehicle lamp device of a third embodiment of the instant disclosure.
Figure 15:
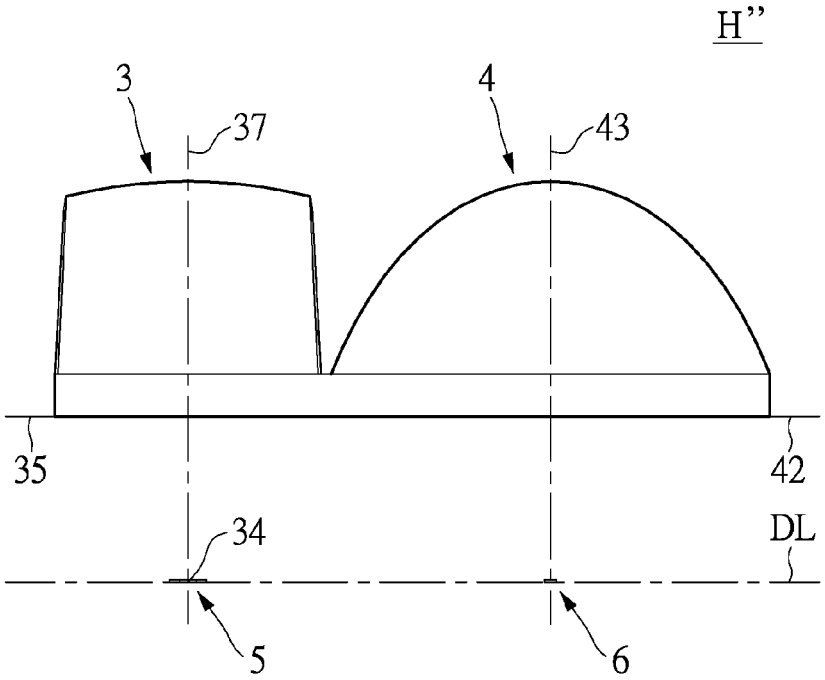
FIG. 15 is a top view of a vehicle lamp device of the third embodiment of the instant disclosure.
Figure 16:
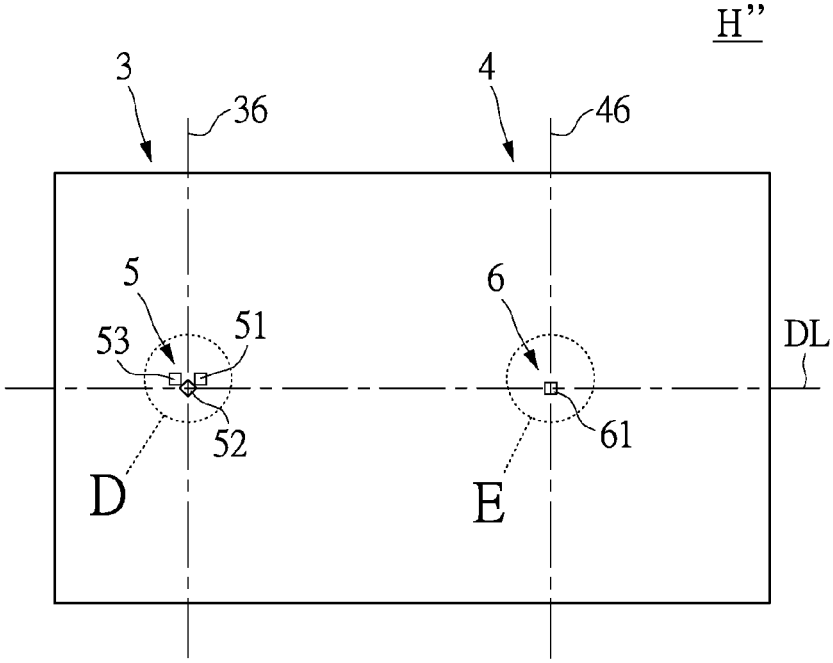
FIG. 16 is a front view of a vehicle lamp device of the third embodiment of the instant disclosure.
Figure 17:
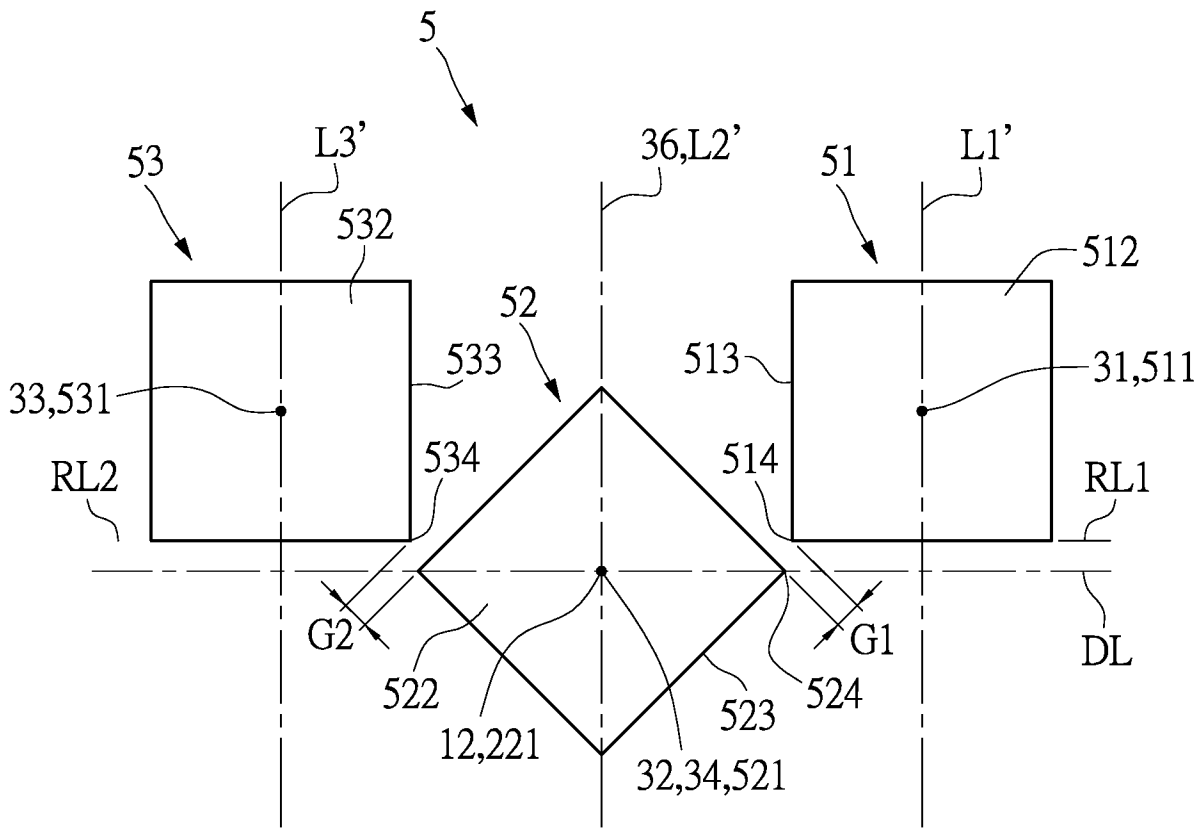
FIG. 17 is a partial enlargement of part D in FIG. 16.
Figure 18:
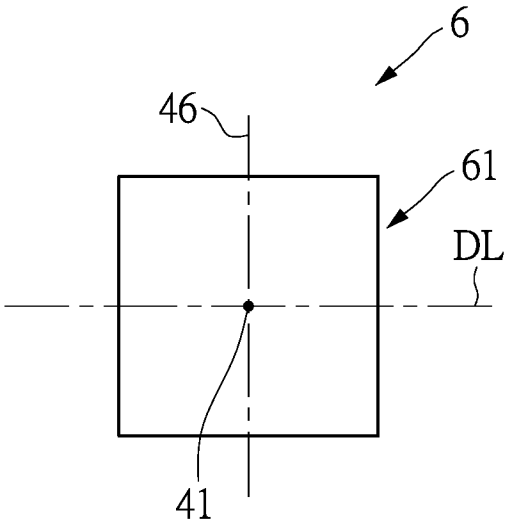
FIG. 18 is a partial enlargement of part E in FIG. 16

Next, please refer to FIG. 13 in addition. The second light emitting group 6 is arranged corresponding to the second lens unit 4. In the second embodiment, the second light emitting group 6 may comprise a first light emitting unit 62 and a second light emitting unit 63. The first light emitting unit 62 of the second light emitting group 6 may be arranged on the first focus 44 of the second lens unit 4. The second light emitting unit 63 of the second light emitting group 6 may be arranged on the second focus 45 of the second light emitting group 6. For example, the light source centers of the first light emitting unit 62 and the second light emitting unit 63 of the second light emitting group 6 may be arranged on the first focus 44 and the second focus 45 of the second lens unit 4 respectively. However, the instant disclosure is not limited thereto. In other embodiments, by adjusting the relative position between the first light emitting unit 62 and the second light emitting unit 63 of the second light emitting group 6 and the first focus 44 and the second focus 45 of the second lens unit 4, the desired light pattern may be formed.

The datum axis DL may pass through the lens focus 34 of the two first lens units 3, the lens focus 41 of the second lens unit 4 and the second light emitting unit 52 of the first light emitting group 5. In addition, the datum axis DL may pass through the first focus 44 and the second focus 45 of the second lens unit 4. In the second embodiment, the datum axis DL may be parallel to the vertical axis 35 of the first lens unit 3, and the datum axis DL is also parallel to the horizontal axis 42 of the second lens unit 4. For example, the datum axis DL may pass through the second light source center 521 of the second light emitting unit 52 of the first light emitting group 5, and the light source centers of the first light emitting unit 62 and the second light emitting unit 63 of the second light emitting group 6. Moreover, the first light emitting unit 62 and the second light emitting unit 63 may be in continuous form or discontinuous form as described in the previous embodiment, i.e., the first light emitting unit 62 and the second light emitting unit 63 may be packed from a plurality of light emitting diode chips, or may be packed from a single light emitting diode chip.

For example, as shown in FIG. 12, the datum axis DL may pass through the second light source center 521 of the second light emitting unit 52 of the first light emitting group 5 and two end points of the second light emitting unit 52. However, the instant disclosure is not limited thereto. In other words, in other embodiments, the datum axis DL does not have to pass through two end points 524 of the second light emitting unit 52 of the first light emitting group 5 and only pass through the second light source center 521 of the second light emitting unit 52, i.e., the datum axis DL only has to pass through two surrounding edges 523 of the second light emitting unit 52.

The first reference axis RL1 may pass through one of the plurality of first surrounding edges 513 of the first light emitting unit 51 of the first light emitting group 5, and the first reference axis RL1 passes through the end point 514 where two adjacent first surrounding edges 513 cross. Therefore, the first reference axis RL1 and the datum axis DL may have a first predetermined angle θ1 therebetween, the first predetermined angle θ1 may be from 0 to 90 degrees. Preferably, the first predetermined angle θ1 is 0 degree. However, the instant disclosure is not limited thereto.

The second reference axis RL2 may pass through one of the plurality of third surrounding edges 533 of the third light emitting unit 53 of the first light emitting group 5, and the second reference axis RL2 also passes through the end point 534 where two adjacent surrounding edges cross. Therefore, the second reference axis RL2 and the datum axis DL may have a second predetermined angle θ2 therebetween, the second predetermined θ2 angle may be from 0 to 90 degrees. In the second embodiment, preferably, the second predetermined angle θ2 is 0. However, the instant disclosure is not limited thereto.

Specifically, as shown in FIG. 12, in the second embodiment, the end point 514 where two adjacent surrounding edges 513 cross is positioned between the datum axis DL and the first light source center 511 of the first light emitting unit 51 of the first light emitting group 5. The end point 534 where two adjacent surrounding edges 533 cross is positioned between the datum axis DL and the first light source center 531 of the first light emitting unit 53 of the first light emitting group 5.

In the second embodiment of the instant disclosure, the first light emitting surface 512 of the first light emitting unit 51 and the second light emitting surface 522 of the second light emitting unit 52 in the first light emitting group 5 may have a first predetermined gap G1 which is the shortest distance therebetween, and the first predetermined gap G1 may be from 0 to 4 millimeter. Preferably, in a continuous light emitting diode, the first predetermined gap G1 may be from 0 to 0.2 millimeter. In a discontinuous light emitting diode, the first predetermined gap G1 may be from 0.2 millimeter to 4 millimeter or from 0.5 millimeter to 4 millimeter. The third light emitting surface 532 of the third light emitting unit 53 and the second light emitting surface 522 of the second light emitting unit 52 in the first light emitting group 5 may have a second predetermined gap G2 which is the shortest distance therebetween, and the second predetermined gap G2 may be from 0 to 4 millimeter. Preferably, in a continuous light emitting diode, the second predetermined gap G2 may be from 0 to 0.2 millimeter. In a discontinuous light emitting diode, the second predetermined gap G2 may be from 0.2 millimeter to 4 millimeter or from 0.5 millimeter to 4 millimeter. In other words, in a discontinuous form, the first light emitting unit 51, the second light emitting unit 52 and the third light emitting unit 53 may be light emitting diode chips packed in a same package, and the first predetermined gap G1 and the second predetermined gap G2 between the first light emitting unit 51, the second light emitting unit 52 and the third light emitting unit 53 may be from 0.2 millimeter to 4 millimeter or from 0.5 millimeter to 4 millimeter. However, in other embodiments, the first light emitting unit 51, the second light emitting unit 52 and the third light emitting unit 53 may be light emitting diodes that are individually packed, and the first predetermined gap G1 and the second predetermined gap G2 between the first light emitting unit 51, the second light emitting unit 52 and the third light emitting unit 53 may be from 0.2 millimeter to 4 millimeter or from 0.5 millimeter to 4 millimeter. In addition, in the continuous form, the first light emitting unit 51, the second light emitting unit 52 and the third light emitting unit 53 may comprise a plurality of light emitting diode chips, and the distances between each light emitting diode chip are from 0 millimeter to 0.2 millimeter.

In addition, for example, one of the plurality of first surrounding edges 513 of the first light emitting unit 51 of the first light emitting group 5 may be parallel to one of the plurality of second surrounding edges 523 of the second light emitting unit 52 of the first light emitting group 5. One of the plurality of third surrounding edges 533 of the third light emitting unit 53 of the first light emitting group 5 may be parallel to one of the plurality of second surrounding edges 523 of the second light emitting unit 52 of the first light emitting group 5. In other words, by adjusting the angle between both of the first reference axis RL1 and the second reference axis RL2 and the datum axis DL, the desired light pattern may be formed. In addition, the desired light pattern may also be achieved by adjusting the relative position between each end point 524 of the second light emitting unit 52 of the first light emitting group 5 and the datum axis DL. It is worthwhile to mention that the relationship between the first lens unit 3 and the first light emitting group 5 provided in the second embodiment is similar to the previous embodiment, and will not be described in detail herein.

The second embodiment of the instant disclosure provides a light distance-adjustable vehicle lamp device H'. By arranging the first light emitting unit 51, the second light emitting unit 52 and the third light emitting unit 53 off-set from each other, the light distance adjustable vehicle lamp device H' may generate a light pattern having larger width and higher brightness compared to the prior art, and also reduce the manufacturing cost. In addition, the light pattern may meet the regulation for high beam and low beam of ECE R113 Class D.

Third Embodiment

First, please refer to FIGS. 14 to 18. The third embodiment of the instant disclosure provides a light distance-adjustable vehicle lamp device H". By comparing FIG. 16 with FIG. 11, one may note that the difference between the third embodiment and the second embodiment resides in that the third embodiment only has one first lens unit 3. The light distance-adjustable vehicle lamp device H" provided by the third embodiment comprises a first lens unit 3, a second lens unit 4, a first light emitting group 5, a second light emitting group 6, a datum axis DL, a first reference axis RL1, and a second reference axis RL2. The first lens unit 3 has a first focus 31, a second focus 32, a third focus 33, a lens focus 34, a horizontal axis 35, a vertical axis 36, and an optical axis 37. The horizontal axis 35 of the first lens unit 3 and the vertical axis 36 of the first lens unit 3 are orthogonal to each other, and the optical axis 37 of the first lens unit 3 passes through the lens focus 34 of the first lens unit 3. The first lens unit 3 provided by the third embodiment is similar to that of the previous embodiments, and will not be described in detail herein.

The second lens unit 4 is closely arranged on one side of the first lens unit 3, and the second lens unit 4 has a lens focus 41, a horizontal axis 42, an optical axis 43 and a vertical axis 46. The optical axis 43 passes through the lens focus 41 of the second lens unit 4, and the optical axis 43 of the second lens unit 4 may be orthogonal to the vertical axis 46 of the horizontal axis 42.

As mentioned above, the first light emitting group 5 is arranged corresponding to the first lens unit 3, and the second light emitting group 6 is arranged corresponding to the second lens unit 4. The first light emitting unit 5 comprises a first light emitting unit 51, a second light emitting unit 52 and a third light emitting unit 53. The first light emitting unit 51 has a first light source center 511, a first axis L1', and a first light emitting surface 512. The first axis L1' passes through the first light source center 511 and is parallel to the vertical axis 36 of the first lens unit 3. The first light emitting surface 512 has a plurality of surrounding edges 513, two adjacent surrounding edges 513 cross at an end point 514. The second light emitting unit 52 has a second light source center 521, a second axis L2' and a second light emitting surface 522. The second axis L2' passes through the second light source center 521, the second axis L2' is parallel to the vertical axis 36 of the first lens unit 3. The second light emitting surface 522 has a plurality of second surrounding edges 523. The third light emitting unit 53 has a third light source center 531, a third axis L3', and a third light emitting surface 532. The third axis L3' passes through the third light source center 531. The third axis L3' is parallel to the vertical axis 36 of the first lens unit 3. The third light emitting surface 532 has a plurality of third surrounding edges 533, two adjacent third surrounding edges 533 cross at an end point 534. The second light emitting unit 52 may be arranged between the first light emitting unit 51 and the third light emitting unit 53. It is worthwhile to mention that the first light source center 511 of the first light emitting unit 51 of the first light emitting group 5 and the first focus 31 of the first lens unit 3 may be arranged corresponding to each other. The second light source center 521 of the second light emitting unit 52 of the first light emitting group 5 and the second focus 32 of the first lens unit 3 may be arranged corresponding to each other. The third light source center 531 of the third light emitting unit 53 of the first light emitting group 5 and the third focus 33 of the first lens unit 3 may be arranged corresponding to each other. The first light emitting group 5 provided by the third embodiment is similar to that of the previous embodiment, and will not be described in detail herein.

The second light emitting group 6 may comprise at least one light emitting unit 61 arranged corresponding to the lens focus 41 of the second lens unit 4. For example, in the third embodiment, the light emitting unit 61 of the second light emitting group 6 may be arranged on the lens focus 41 of the second lens unit 4. Furthermore, the center of the light emitting unit 61 of the second light emitting group 6 may coincide with the lens focus 41 of the second lens unit 4. However, the instant embodiment is not limited thereto. In other embodiments, by adjusting the relative position between the light emitting unit 61 and the lens unit 41, the required light pattern may be formed. For example, the center of the light emitting unit 51 may be arranged on a side of the lens focus 41.

The datum axis DL may pass through the lens focus 34 of the first lens unit 3, the lens focus 41 of the second lens unit 4, and the second light emitting unit 52 of the first light emitting group 5. For example, the datum axis DL may pass through the second light source center 521 of the second light emitting unit 52 of the first light emitting group 5. The datum axis DL provided by the third embodiment is similar to that of the previous embodiments, and will not be described in detail herein.

The first reference axis RL1 may pass through one of the plurality of first surrounding edges 513, and the first reference axis RL1 may pass through the end point 514 where two adjacent first surrounding edges 513 cross. The first reference axis RL1 and the datum axis DL1 may have a first predetermined angle θ1 positioned therebetween, and the first predetermined angle θ1 is from 0 to 90 degrees. Preferable, in the third embodiment, the first predetermined angle θ1 is 0 degree. Next, the second reference axis RL2 may pass through one of the plurality of third surrounding edges 533, and the second reference axis RL2 passes through the end point 534 where two third surrounding edges 533 cross. The second reference axis RL2 and the datum axis DL2 may have a second predetermined angle θ2 therebetween, and the second predetermined angle θ2 may be from 0 to 90 degrees. Preferably, in the third embodiment, the second predetermined angle θ2 is 0 degree. However, the instant disclosure is not limited thereto. The first reference axis RL1 and the second reference axis RL2 provided by the third embodiment are similar to that of the previous embodiment, and will not be described in detail herein.

In the third embodiment, the end points 514 where two first surrounding edge 513 cross may be positioned between the datum axis DL and the first light source center 511 of the first light emitting unit 51 of the first light emitting group 5. The end point 534 where two third surrounding edges 533 cross may be positioned between the datum axis DL and the third light source center 531 of the third light emitting unit 53 of the first light emitting group 5.

By arranging the first light emitting unit 51 and the second light emitting unit 52 off-set from each other, the light distance-adjustable vehicle lamp device H" provided by the instant disclosure may generate light patterns with larger width compared to the prior art and has lower manufacturing cost. In addition, the light pattern may meet the regulation for high beam and low beam of ECE R113 Class C.

Fourth Embodiment

Figure 19:
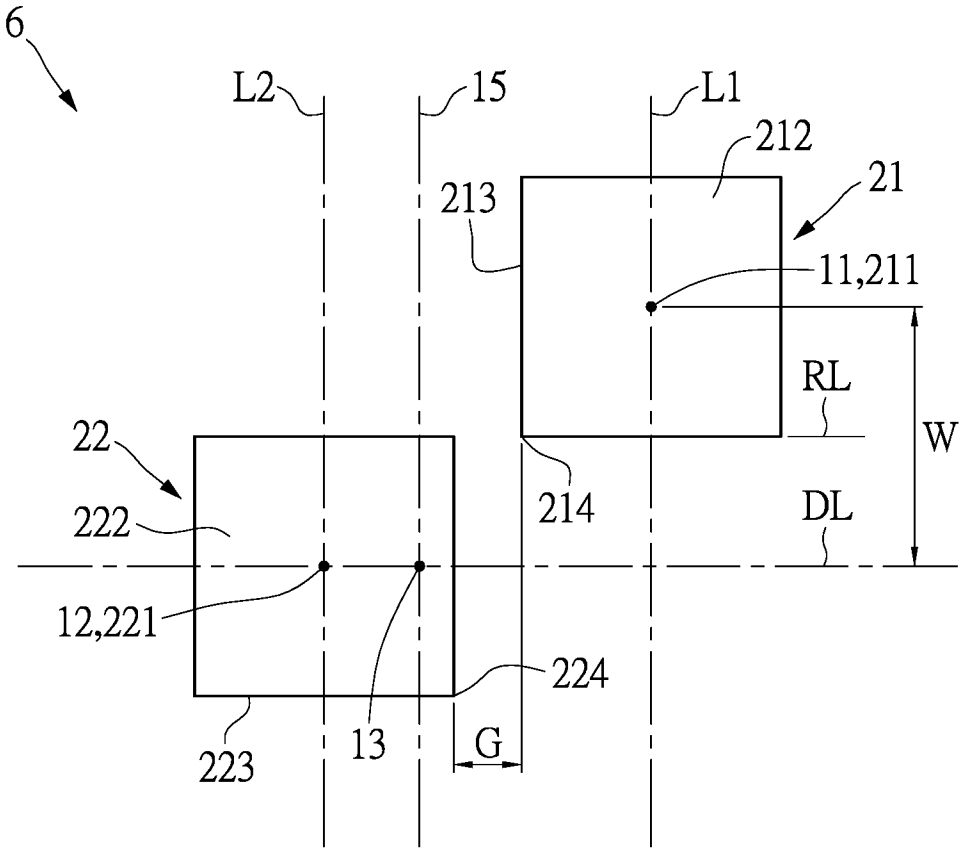
FIG. 19 is a partial enlargement of a front view of a vehicle lamp device of a fourth embodiment of the instant disclosure.

Please refer to FIG. 19. The fourth embodiment is different from the first embodiment in the arrangement of the first light emitting unit 21 and the second light emitting unit 22. To be specific, in the fourth embodiment, the datum axis DL may pass through the second light source center 221 of the second light emitting unit 22 and is parallel to two of the second surrounding edges 223. One of the first surrounding edges 213 of the first light emitting unit 21 is parallel with one of the second surrounding edges 223. A predetermined spacing W between the first light source center 211 and the second light source center 221 along the vertical axis may be from 0.5 to 2.3 millimeter. The datum axis DL and the reference axis RL of the second light emitting group 2 are similar to the previous embodiments, and will not be described in detail herein.

Fifth Embodiment

Figure 20:
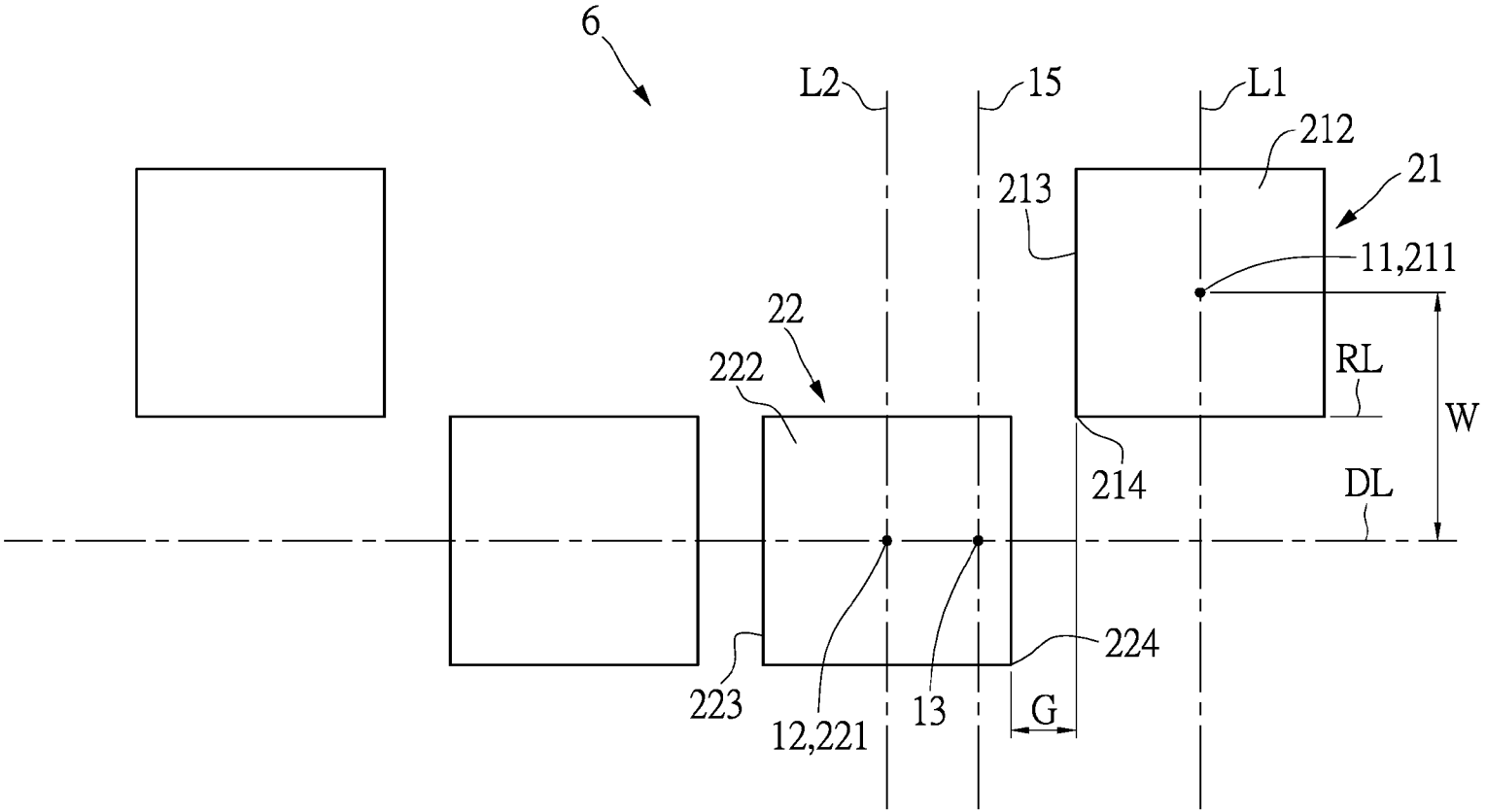
FIG. 20 is a partial enlargement of a front view of a vehicle lamp device of a fifth embodiment of the instant disclosure.

Please refer to FIG. 20. The difference between the fifth embodiment and the fourth embodiment resides in that four light emitting units are arranged in conjunction with one lens unit. To be specific, the lens unit 1 provided by the fifth embodiment may have four focuses corresponding to four light emitting units respectively, and the lens focus 13 may be positioned between the four light emitting units and on the datum axis DL. Accordingly, the it is able to adjust the distance of the light pattern under the use of only one lens.

Effects Achieved by the Embodiments

In sum, the advantages provided by the instant disclosure is that by utilizing the combination of one lens unit 1 and at least two light emitting units, and off-setting two light emitting units from each other, it is able to achieve the light distance adjustment under the use of one lens.

In addition, the light distance-adjustable vehicle lamp device (H, H", H"') provided by the embodiment of the instant disclosure may employ continuous form emitters by comprising only one package in which the distance between each light emitting diode in the package are from 0 millimeter to 0.2 millimeter or form 0 millimeter to 0.5 millimeter. The light distance-adjustable vehicle lamp device (H, H", H"') provided by the embodiment of the instant disclosure may also employ discontinuous form emitters by comprising one or more packages in which the distance between each light emitting diode in the package are from 0.2 millimeter to 4 millimeter or from 0.5 millimeter to 4 millimeter.

Moreover, based on the combination of multiple axis (the first axis L1, L1', the second axis L2, L2' and the third axis L3') and the multiple focuses of the lens, the light distance-adjustable vehicle lamp device (H, H", H"') provided by the embodiment of the instant disclosure may employ discontinuous light emitting diode packages to reduce the cost of the entire vehicle lamp device (H, H', H").

The above-mentioned descriptions represent merely the exemplary embodiments of the instant disclosure, without any intention to limit the scope of the instant disclosure thereto. Various equivalent changes, alterations or modifications based on the claims of present disclosure are all consequently viewed as being embraced by the scope of the instant disclosure.

What is claimed is:

1. A light distance-adjustable vehicle lamp device, comprising:

a lens unit having a first focus, a second focus, a lens focus and an optical axis, wherein the optical axis passes through the lens focus;

a light emitting group arranged corresponding to the lens unit, the light emitting group comprises:

a first light emitting unit having a first light source center, a first axis and a first light emitting surface, the first axis passes through the first light source center, the first light emitting surface has a plurality of first surrounding edges, two adjacent first surrounding edges cross at an end point, wherein the first light emitting unit corresponds to the first focus of the lens unit; and a second light emitting unit arranged corresponding to the first light emitting unit, the second light emitting unit has a second light source center, a second axis and a second light emitting surface, the second axis passes through the second light source center, the second light emitting surface has a plurality of second surrounding edges, wherein the second light emitting unit corresponds to the second focus of the lens unit;

a datum axis passing through the lens focus and the second light emitting unit; and a reference axis passing through one of the plurality of first surrounding edges, and the reference axis passes through the end points, wherein the reference axis and the datum axis have a predetermined angle therebetween, and the predetermined angle is between 0 and 90 degrees;

wherein the lens focus is positioned between the first axis and the second axis;

wherein the end point is positioned between the datum axis and the first light source center;

wherein the first light emitting surface and the second light emitting surface are apart from each other for a predetermined gap, and the predetermined gap is from 0 to 4 millimeter.

2. The light distance-adjustable vehicle lamp device of claim 1, wherein the first light source center coincides with the first focus, the second light source center coincides with the second focus.

3. The light distance-adjustable vehicle lamp device of claim 1, wherein one of the plurality of first surrounding edges is parallel to one of the plurality of second surrounding edges.

4. The light distance-adjustable vehicle lamp device of claim 1, wherein a distance from the lens focus to the first axis is equal to a distance from the lens focus to the second axis.

5. The light distance-adjustable vehicle lamp device of claim 1, wherein a predetermined spacing between the first light source center and the second light source center along the vertical axis is from 0.5 to 2.3 millimeter.

6. A light distance-adjustable vehicle lamp comprising:

two first lens units, each first lens unit has a first focus, a second focus, a third focus, a lens focus, a horizontal axis, a vertical axis, an optical axis, wherein the horizontal axis of the first lens unit is orthogonal to the vertical axis of the first lens unit, the optical focus of the first lens unit passes through the lens focus of the first lens unit;

a second lens unit arranged between two first lens units, the second lens comprises a lens focus, a horizontal axis and an optical axis, the optical axis of the second lens unit passes through the lens focus of the second lens unit;

two first light emitting groups arranged corresponding to the two first lens units respectively, each first light emitting group comprises:

a first light emitting unit having a first light source center, a first axis and a first light emitting surface, wherein the first axis passes through the first light source center, the first axis is parallel to the vertical axis of the first lens unit, the first light emitting surface has a plurality of first surrounding edges, two adjacent first surrounding edges cross at an end point;

a second light emitting unit having a second light source center, a second axis and a second light emitting surface, the second axis passes through the second light source center, the second axis is parallel to the vertical axis, and the second light emitting surface has a plurality of second surrounding edges; and a third light emitting unit, the third light emitting unit has a third light source center, a third axis and a third light emitting surface, wherein the third axis passes through the third light source center, the third axis is parallel to the vertical axis of the first lens unit, the third light emitting surface has a plurality of third surrounding edges, two adjacent third surrounding edges cross at an end point;

wherein the second light emitting unit is arranged between the first light emitting unit and the third light emitting unit;

a second light emitting group arranged corresponding to the second lens unit, wherein the second light emitting group comprises at least a light emitting unit, at least one light emitting unit of the second light emitting group is arranged corresponding to the lens focus of the second lens unit;

a datum axis, the datum axis passes through the lens focuses of the two first lens units, the lens focus of the second lens unit, and the second light emitting units of the two first light emitting groups;

a first reference axis, the first reference axis passes through one of the plurality of the first surrounding edges, and the first reference axis passes through the end point where the two adjacent first surrounding edges cross, wherein the first reference axis and the datum axis have a predetermined angle therebetween, and the predetermined angle is from 0 to 90 degrees; and a second reference axis, the second reference axis passes through one of the plurality of the third surrounding edges, and the second reference axis passes through the end point where the two adjacent third surrounding edges cross, wherein the second reference axis and the datum axis has a second predetermined angle therebetween, and the predetermined angle is from 0 to 90 degrees;

wherein the end point where the two adjacent first surrounding edges cross is positioned between the datum axis and the first light source center of the first light emitting unit of the first light emitting group;

wherein the end point where the two adjacent third surrounding edges crossed is positioned between the datum axis and the third light source center of the third light emitting unit of the first light emitting group;

wherein the first light source centers of the first light emitting units of the two first light emitting groups are arranged corresponding to the first focuses of the two first lens units respectively;

wherein the second light source centers of the second light emitting units of the two first light emitting groups are arranged corresponding to the second focuses of the two first lens units respectively;

wherein the third light source centers of the third light emitting units of the two first light emitting groups are arranged corresponding to the third focuses of the two first lens unit respectively;

wherein the first light emitting surface and the second light emitting surface are apart from each other for a predetermined gap, and the predetermined gap is from 0 to 4 millimeter.

7. The light distance-adjustable vehicle lamp device of claim 6, wherein the second lens unit comprises a first focus and a second focus, the second light emitting group comprises a first light emitting unit and a second light emitting unit, the first light emitting unit of the second light emitting group is arranged on the first focus of the second lens unit, the second light emitting unit of the second light emitting group is arranged on the second focus of the second lens unit.

8. The light distance-adjustable vehicle lamp device of claim 6, wherein one of the plurality of the first surrounding edges is parallel to one of the plurality of the second surrounding edges, one of the plurality of the third surrounding edges is parallel to one of the plurality of the second surrounding edges.

9. A light distance-adjustable vehicle lamp device, comprising:

a first lens unit having a first focus, a second focus, a third focus, a lens focus, a horizontal axis, a vertical axis and an optical axis, wherein the horizontal axis of the first lens unit is orthogonal to the vertical axis of the first lens unit, the optical axis of the first lens unit passes through the lens focus of the first lens unit;

a second lens unit closely arranged on one side of the first lens unit, the second lens unit comprises a lens focus, a horizontal axis and an optical axis, the optical axis of the second lens unit passes through the lens focus of the second lens unit;

a first light emitting group, the first light emitting group is arranged corresponding to the first lens unit, the first light emitting group comprises:

a first light emitting unit having a first light source center, a first axis and a first light emitting surface, wherein the first axis passes through the first light source center, the first axis is parallel to the vertical axis of the first lens unit, the first light emitting surface comprises a plurality of first surrounding edges, two adjacent first surrounding edges cross at an end point;

a second light emitting unit having a second light source center, a second axis and a second light emitting surface, the second axis passes through the second light source center, the second axis is parallel to the vertical axis, the second light emitting surface comprises a plurality of second surrounding edges; and a third light emitting unit having a third light source center, a third axis and a third light emitting surface, wherein the third axis passes through the third light source center, the third axis is parallel to the vertical axis of the first lens unit, the third light emitting surface comprises a plurality of third surrounding edges, two adjacent first surrounding edges cross at an end point;

wherein the second light emitting unit is arranged between the first light emitting unit and the third light emitting unit;

a second light emitting group arranged corresponding to the second lens unit, wherein the second light emitting group comprises at least a light emitting unit, at least one light emitting unit of the second light emitting group is arranged corresponding to the lens focus of the second lens unit;

a datum axis, the datum axis passes through the lens focus of the first lens unit, the lens focus of the second lens unit and the second light emitting unit of the first light emitting group;

a first reference axis, the first reference axis passes through one of the plurality of first surrounding edges, and the first reference axis passes through the end point where two adjacent first surrounding edges cross, wherein the first reference axis and the datum axis have a first predetermined angle therebetween, the predetermined angle is from 0 to 90 degrees; and a second reference axis, the second reference axis passes through one of the plurality of third surrounding edges, and the second reference axis passes through the end point that two adjacent third surrounding edges cross, wherein the second reference axis and the datum axis have a second predetermined angle therebetween, the second predetermined angle is from 0 to 90;

wherein the end point where two adjacent first surrounding edges cross is positioned between the datum axis and the first light source center of the first light emitting unit of the first light emitting group;

wherein the end point where two adjacent third surrounding edges cross is positioned between the datum axis and the third light source center of the third light emitting unit of the first light emitting group;

wherein the first light source center of the first light emitting unit of the first light emitting group is arranged corresponding to the first focus of the first lens unit;

wherein the second light source center of the second light emitting unit of the first light emitting group is arranged corresponding to the second focus of the first lens unit;

wherein the third light source center of the third light source unit of the first light emitting group is arranged corresponding to the third focus of the first lens unit;

wherein the first light emitting surface and the second light emitting surface are apart from each other for a predetermined gap, and the predetermined gap is from 0 to 4 millimeter.

* * * * *